US006092566A

United States Patent [19]

Yazawa et al.

[11] Patent Number: 6,092,566

[45] Date of Patent: Jul. 25, 2000

[54] DOUBLE CHAMBER AEROSOL CONTAINER AND MANUFACTURING METHOD THEREFOR

[75] Inventors: Iwao Yazawa, Higashimurayama; Toshiyuki Mitsui, Saitama-ken; Yukio Hachinohe, Sakado; Kazunori Hoshino, Zushi; Kazuhide Maeda, Higashimurayama; Koh Naito, Urawa, all of Japan

[73] Assignee: Toyo Aerosol Industry Co., Ltd., Tokyo, Japan

[21] Appl. No.: 09/216,876

[22] Filed: Dec. 21, 1998

[30] Foreign Application Priority Data

Oct. 1, 1998 [JP] Japan ..... 10-280120

[51] Int. Cl.[7] ..... A61M 11/06; A61M 16/00

[52] U.S. Cl. ..... 141/20; 141/3; 222/386.5; 222/389; 53/470; 53/266.1

[58] Field of Search ..... 222/386–389; 141/3, 20; 53/470, 266.1, 284.5

[56] References Cited

U.S. PATENT DOCUMENTS

| | | | |
|---|---|---|---|
| 3,477,195 | 11/1969 | Chambers | 53/470 |
| 3,549,058 | 12/1970 | Bolk | 222/386.5 |
| 3,636,993 | 1/1972 | Thornton | 141/20 |
| 3,700,136 | 10/1972 | Ruekberg | 222/386.5 |
| 4,045,860 | 9/1977 | Winckler | 222/386.5 |
| 4,108,219 | 8/1978 | Shulsinger | 141/3 |
| 4,211,344 | 7/1980 | Stoody | 141/20 |
| 4,346,743 | 8/1982 | Miller | 141/3 |

*Primary Examiner*—J. Casimer Jacyna
*Attorney, Agent, or Firm*—Kanesaka & Takeuchi

[57] ABSTRACT

A double chamber aerosol container capable of filling contents in the container upon cutting off open air has an inner sack, whose volume is reducible according to reduction of contents, formed with temporarily engaging portions. A housing to which a valve assembly is arranged is inserted in the inner sack where the temporarily engaging portions are temporarily engaged with a ring-shaped neck portion of an outer container. After propellant is filled in a space between the inner sack 1 and the outer container during this temporarily engagement, the inner sack is inserted in the outer container to form the double chamber aerosol container.

2 Claims, 8 Drawing Sheets

DOUBLE CHAMBER AEROSOL CONTAINER AND MANUFACTURING METHOD THEREFOR

BACKGROUND OF THE INVENTION

1. Field of the Invention

This invention relates to a double chamber aerosol container used where contents, such as hair care products, cosmetics, antiperspirants, deodorants, other human body treatment products, insecticides, coating materials, cleaners, other products for household, industrial materials, automobile goods, medicines, foods, and so on, are filled in an inner sack and where a propellant is filled in an outer container and to a manufacturing method therefor.

2. Description of Related Art

Containers in which an inner sack filled with contents is mounted within an outer container and its volume is reducible in according to reduction of the contents, have been known previously. Such a double-chamber aerosol container is used for preparations in which any direct contact between the propellant and the aerosol contents is not favorable.

In such a conventional double chamber aerosol container, the inner sack is attached inside the aerosol container where an edge of an orifice of the inner sack is engaged with a bead portion of the aerosol container and where the lower end of the inner sack is in contact with the bottom of the aerosol container. Contents only, without any propellant, are filled within the inner sack thus mounted.

After those contents are filled, the container cap is fitted inside the inner sack. After an upper opening of the inner sack is disposed at a space between the container cap and the bead portion of the aerosol container, the inner sack and the container cap are lifted upward to form a filling gap for the propellant between the outer periphery of the opening of the inner sack and the bead portion of the aerosol container, and thereby the propellant is filled within the aerosol container via the filling gap.

With this conventional method, however, the exterior is in air communication with the inside of the inner sack, because the contents are placed in the inner sack where the inner sack before the container cap is fitted is mounted within the container, so that unfavorable conditions such that some bacteria are mixed or the contents are oxidized may occur. If the contents are filled in such a circumstance, the contents may be spilt out when the container cap is fitted where the contents are filled up closely to the opening of the inner sack. On the other hand, if the contents are filled in a smaller amount, the air may remain in the inner sack, and as a result, the contents may be oxidized or deteriorated.

Where the contents are agent type using an isopentane in a gel form or the like, the contents may be deteriorated due to contacts with the open air, or the isopentane may evaporate and generate bubbles where the temperature of the isopentane increases due to contacts with the open air, and those raise problems during such filling work. Where the open air contacts with the contents, such contacts are not favorable for medicines, cosmetics, foods, and so on for which prevention of contamination is strongly demanded.

SUMMARY OF THE INVENTION

It is an object of the invention, from a viewpoint to solve the problems above, to provide an aerosol container capable of preventing contents from contacting with open air during filling of the contents to keep the contents away from mixture of bacteria or deterioration or the like due to oxidation of the contents.

It is another object of the invention to provide an aerosol container not subject to overfilling or shortage of filling of the contents and, even if subject to shortage of filling, not subject to oxidation due to contacts between the open air and the contents.

It is yet another object of the invention to provide an aerosol container in which an inner peripheral surface of an outer container and the outer peripheral edge of an opening of an inner sack are surely engaged with each other and secured as not to create leaks, thereby preventing the contents from deteriorated due to oxidation.

The foregoing objects are accomplished with an aerosol container including: an outer container having a hollow interior and a ring-shaped neck portion extending radially inward from a surface of the hollow interior; an inner sack, whose volume is reducible according to reduction of contents, inserted in the hollow interior of the outer container to be mounted, the inner sack having an opening for containing the contents and a plurality of temporarily engaging portions extending from an outer surface of the inner sack radially more outward than the neck portion; a housing formed with a valve assembly and inserted in an inner periphery of the opening of the inner sack for constituting, together with the inner sack, a container for the contents; and an O-ring tightly secured to an outer periphery of the inner sack to engage the inner sack with the housing, wherein the inner sack and the outer container are temporarily fitted with each other by engagement of the temporarily engaging portions of the inner sack with the ring-shaped neck portion, wherein a filling gap for propellant is formed between the inner sack and the aerosol container while the inner sack and the outer container are temporarily fitted, and wherein the O-ring is airtightly engaged with the ring-shaped neck portion at a time of a permanent engagement in which the container for contents are inserted in the outer container.

In another aspect of the invention, a method for manufacturing a double chamber aerosol container according to the invention includes the steps of: inserting a housing formed with a valve assembly into an inner periphery of an opening of an inner sack, whose volume is reducible according to reduction of contents, the inner sack having a plurality of temporarily engaging portions extending outward from an outer surface of the inner sack radially more than a ring-shaped neck portion extending radially inward from a surface of the hollow interior of an outer container to engage the housing with the inner sack by means of an O-ring tightly secured to an outer periphery of the inner sack; temporarily engaging the temporarily engaging portions of the inner sack with the ring-shaped neck portion upon inserting in the outer container the inner sack of a container for contents, which is constituted of the inner sack and the housing, to form a filling gap for propellant between the outer container and the temporarily engaging portions of the inner sack while the temporarily engaging portions and the ring-shaped neck portion are temporarily engaged; filling the propellant in the outer container upon connecting a filling head for propellant to the outer container while the temporarily engaging portions and the ring-shaped neck portion are temporarily engaged; securing a top edge of the outer container to an upper surface of the housing by folding the top edge after the O-ring is airtightly engaged with the ring-shaped neck portion upon inserting the inner sack in the outer container as the temporarily engaging portions of the inner sack slide beyond the ring-shaped neck portion of the outer container, and filling the contents in the inner sack via the valve assembly after the inner sack and the outer container are thus permanently engaged.

To manufacture the double chamber aerosol container thus constituted, first, the housing is inserted into the inner sack in which the contents are filled before the contents are filed in the sack. Although this inner sack has a plurality of temporarily engaging portions extending from an outer surface of the inner sack radially more outward than the ring-shaped neck portion, which extends radially inward from a surface of the hollow interior of the outer container, the housing formed with the valve assembly is inserted in the inner periphery of the opening. During this insertion, the O-ring is closely secured to the outer periphery of the inner sack, and the housing and the inner sack are engaged with each other via this O-ring as to constitute the container for contents by the inner sack and the housing.

The plural temporarily engaging portions extending radially more outward than the ring-shaped neck portion, which extends radially inward from a surface of the hollow interior of the outer container, are provided on the outer periphery of the inner sack. The temporarily engaging portions can be arranged on the outer periphery of the inner sack with a proper space therebetween, or can be formed of an inner sack in a pleat form.

The inner sack and the outer container are temporarily fitted by engagement between the temporarily engaging portions of the inner sack and the ring-shaped neck portion, and during this temporarily engaging state, the filling gap for propellant is formed between the outer container and the inner sack. The filling head for propellant is then coupled to the outer container in the temporarily engaging state, filling the propellant into the outer container via the filling gap.

After this filling is completed, the inner sack is inserted in the outer container as the temporarily engaging portions of the inner sack, which are engaged with the ring-shaped neck portion of the outer container, slide beyond the ring-shaped neck portion of the outer container. Although the temporarily engaging portions of the inner sack extend radially more outward than the ring-shaped neck portion of the outer container, the inner sack can be so transformed that its volume is reducible according to reduction of contents, and the inner sack is easily inserted in the outer container as the temporarily engaging portions of the inner sack slide beyond the ring-shaped neck portion of the outer container by pressing the housing strongly.

After the O-ring and the ring-shaped neck portion are closely engaged airtightly, the top edge of the outer container is secured to the upper surface of the housing by folding the edge. By this folding, the container for contents and the outer container are secured airtightly in a united body. The contents are introduced in the inner sack via the valve assembly after the container for contents and the outer container are thus engaged permanently.

This invention thus can make the inside of the inner sack not in contact with the open air since the housing and the inner sack are in an engagement state before those are mounted within the outer container. The contents are filled by way of the valve assembly, and therefore, when filled in the inner sack, the contents can be filled without contacting with the open air and avoid overfilling. Thus, there will be no problem where contents easily oxidized or contents such as gel foams generating bubbles from increase of temperature due to contacts with the open air are filled. Because this invention allows the contents to be filled without contacting the open air, it is particularly favorable for medicines, cosmetics, foods, and so on, in which prevention of contamination is strongly demanded. Moreover , because the housing and the inner sack are in the engagement relation before those are mounted in the outer container, those are easily handled, and the work productivity can become very high.

The contents to be filled in the inner sack are, as hair care products, hair sprays, hair treatments, hair shampoos, hair conditioners, acidic hair dyes, oxidizing two-agent type permanent hair dyes, color spray-decolorant, agents for permanently waving treatment, hair restorers, hair foams, hair tonics, sprays for correcting bad hair, fragrances for hair, and so on.

As cosmetics, exemplified are shaving creams, after-shave lotions, after-shave gels, perfumes and Eau de Colognes, facial cleansing agents, sunscreens, beauty washes, foundation creams, depilatories, decolorants, bath gels, toothpastes, skin care foams, and so on.

As deodorants and antiperspirants, exemplified are, e.g., antiperspirants, deodorants, body shampoos, etc. As other human body treatment goods, exemplified are muscular antiphlogistics, skin disease treatments, dermatophytosis medicines, insect repellents, cleaners, oral agents, salves, burning medicines, etc.

As insecticides, exemplified are, e.g., air-spray insecticides, insecticides for cockroach, insecticides for gardening, insecticides for ticks, pesticides for noxious insects, etc. As coating agents, exemplified are, e.g., paints for house, paints for automobile, undercoating agents, etc.

As cleaners, exemplified are glass cleaners for house, carpet cleaners, bath cleaners, floor and furniture cleaners, shoe and skin cleaners, wax cleaners, etc. As other goods for household, exemplified are, e.g., room deodorants, deodorants for toilet, waterproofing agents, starches for washing, herbicides, insecticides for clothes, flame proofing agents, fire extinguishers, antifungals, deodorants for garbage, etc.

As industrial use, exemplified are, e.g., lubricants, anticorrosives, adhesives, metal flaw detecting agents, mold-releasing agents, caulking agents, etc. As automobile use, exemplified are, e.g., defrosting agents, antifreezing or thawing agents, puncture repairers, engine cleaners, etc. As other uses, exemplified are, e.g., pet care goods, hobby goods, amusement goods, foods such as coffee, juices, creams, cheeses, etc.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF PREFERRED EMBODIMENTS

Figure 1:
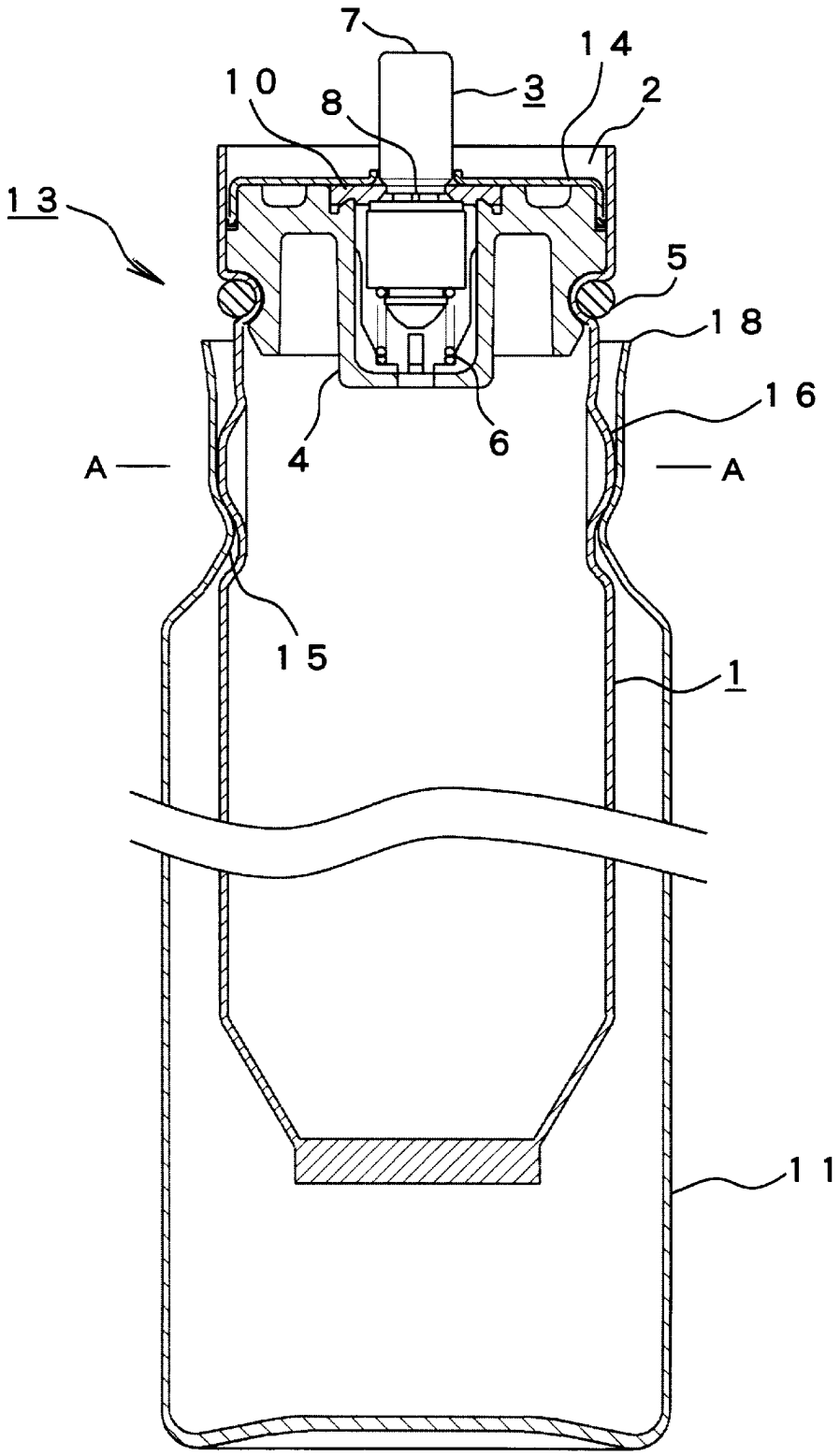
FIG. 1 is a cross section showing an aerosol container in a state that a container for contents is temporarily fitted in an outer container according to a first embodiment of the invention.

Referring to FIGS. 1 to 4, a double chamber aerosol container and a method for manufacturing the aerosol container are described. Numeral 1 is an inner sack and is formed of a soft material so that the volume is reducible according to reduction of the contents filled therein. A housing 4 to which a valve assembly 3 is disposed is inserted and secured to an inner periphery of an opening 2 of the inner sack 1 as shown in FIG. 1. In this insertion, the housing 4 and the inner sack 1 are secured as hardly separable by securing an outer periphery of an inner sack 1 in which the housing 4 is inserted by the O-ring 5.

The valve assembly 3 can be constituted of a known structure, and a stem 7 that is urged outward by a coil spring 6 is inserted in this housing 4. Since an orifice 8 of the stem 7 is sealed with an inner peripheral surface of a ring-shaped gasket 10, the inside and outside of an outer container 13 are not in communication with each other except the stem 7 is pressed, and therefore, the assembly 3 prevents contents 11 from spraying out. The inner sack 1 and the housing 4 constitute a container 13 for contents. A metal cover plate 14, at a center of which the stem 7 passes, is provided on a top surface of the housing 4.

To remove the air in the inner sack 1, the air in the inner sack 1 is vacuumed and discharged outside where the stem 7 of the valve assembly 3 is pressed down and released before the inner sack 1 is attached in the outer container 11. This discharge of the air in the inner sack 1 is not necessarily made, and it is enough that the air in the inner sack 1 of a considerable volume is discharged. The inner sack 1 is preferably vacuumed but not necessarily made. The inner sack 1 thus vacuumed is inserted within the outer container 11 .

Figure 2:
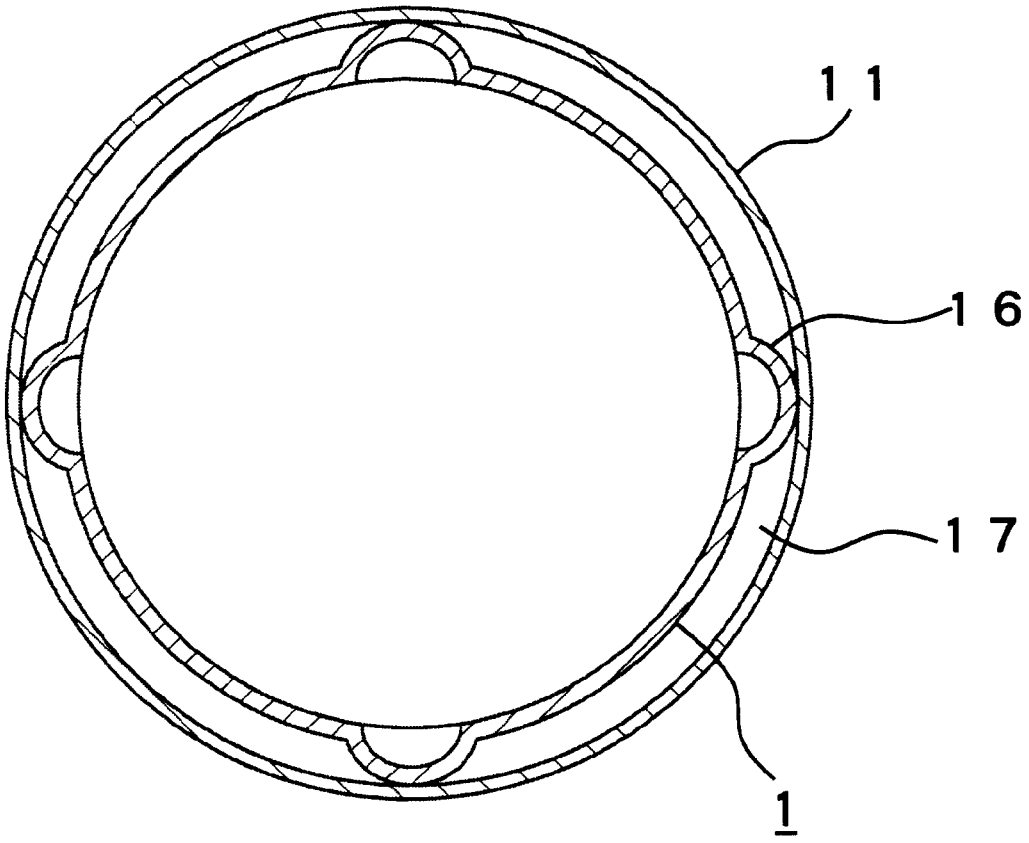
FIG. 2 is an enlarged cross section showing a cut face of the container taken along A—A line in FIG. 1.
Figure 3:
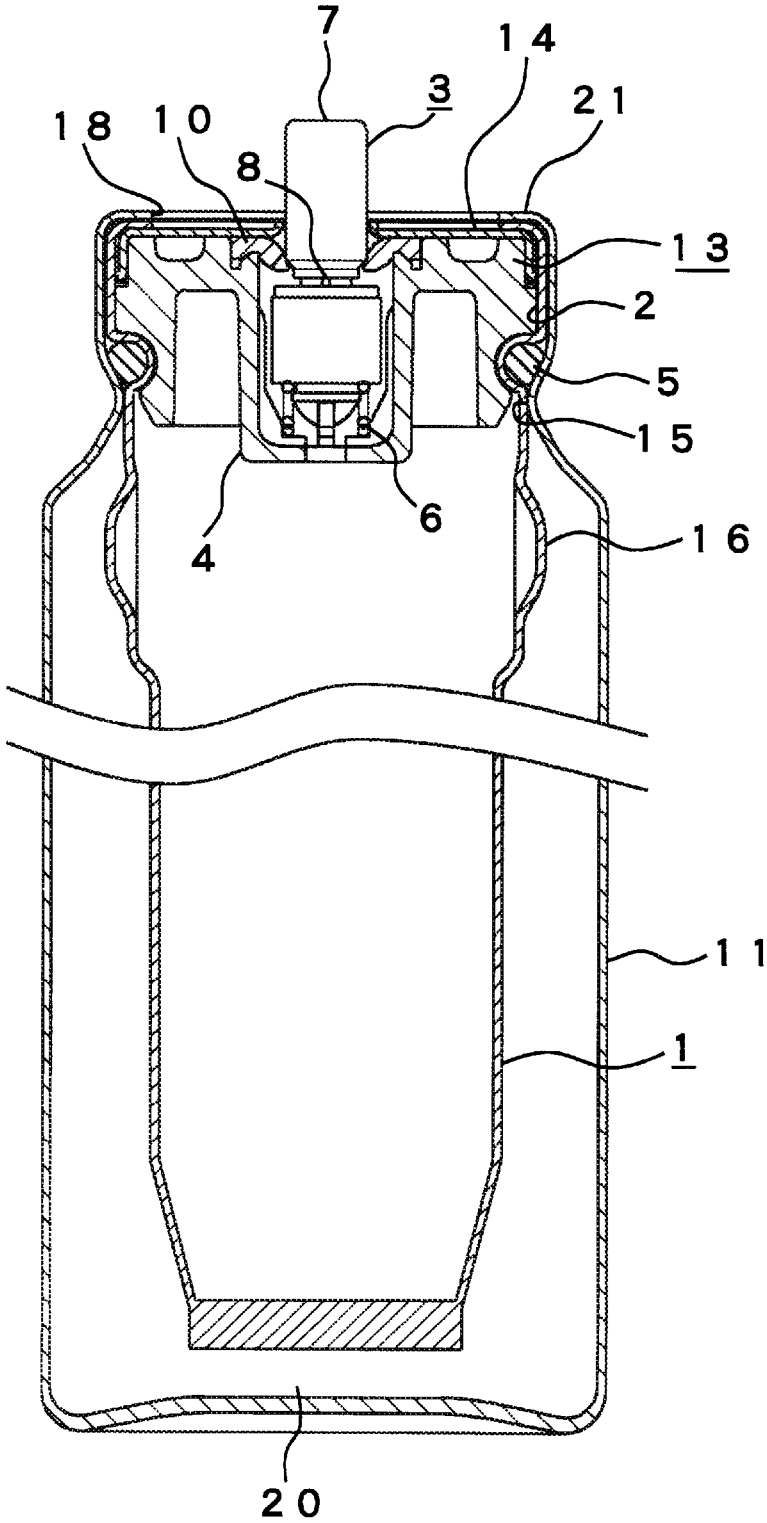
FIG. 3 is a cross section showing a state that the container for contents is permanently fitted in the outer container according to the first embodiment of the invention.
Figure 4:
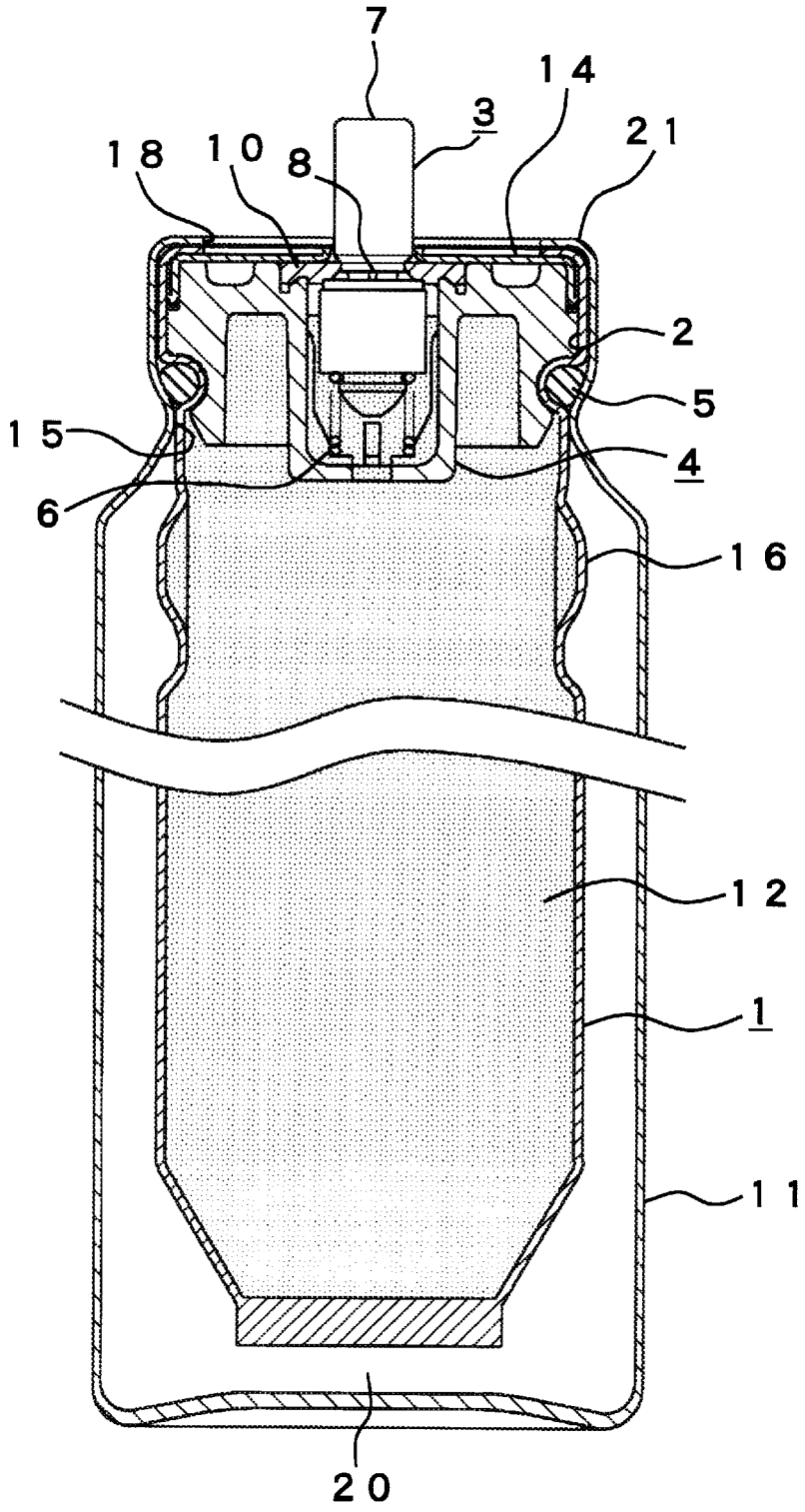
FIG. 4 a cross section showing the container according to the first embodiment in a state that the, contents are filled in the inner sack.
Figure 5:
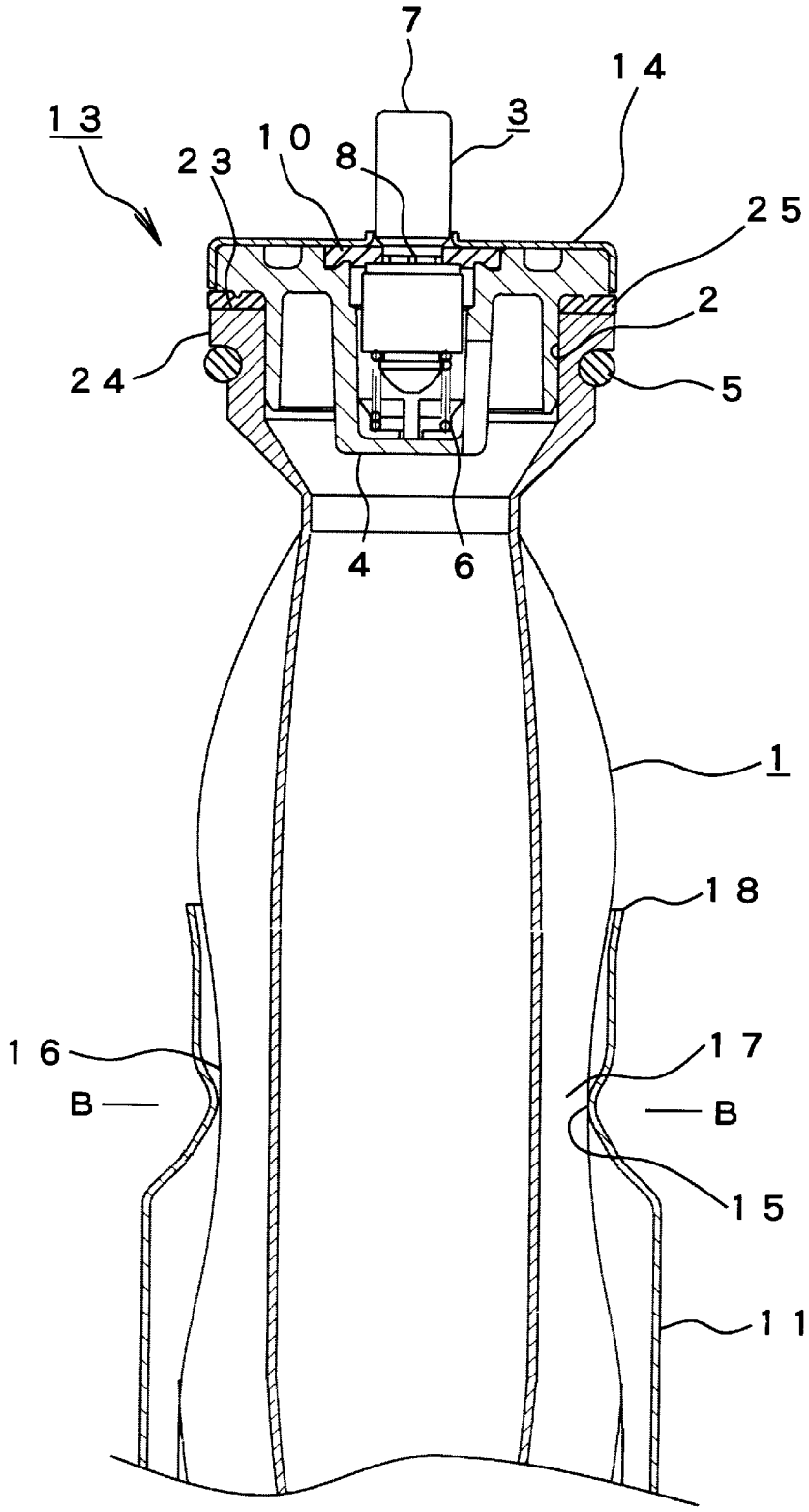
FIG. 5 is a cross section showing a container according to the second embodiment in a state that the container for contents are temporarily fitted in the outer container.

The plural temporarily engaging portions 16 extending radially more outward than the ring-shaped neck portion 15, which extends radially inward from a surface of the hollow interior of the outer container 11, are provided on the outer periphery of the inner sack 1. The four temporarily engaging portions 16 are arranged as shown in FIG. 2 on the outer periphery of the inner sack 1 with a proper space therebetween.

The inner sack 1 and the outer container 11 are temporarily fitted as shown in FIG. 1 by engagement between the temporarily engaging portions 16 of the inner sack 1 and the ring-shaped neck portion 15, and during this temporarily engaging state, a filling gap 17 for propellant is formed between the outer container 11 and the inner sack 1. A filling head, not shown, for propellant is then coupled to the outer container in the temporarily engaging state, and the propellant is filled into the outer container 11 after the air in the outer container 11 is removed outside by vacuuming via the filling gap.

After this filling is completed, the inner sack 1 is inserted in the outer container 11 as the temporarily engaging portions 16 of the inner sack 1, which are engaged with the ring-shaped neck portion 15 of the outer container 11, slide beyond the ring-shaped neck portion 15. Although the temporarily engaging portions 16 of the inner sack 1 extend radially more outward than the ring-shaped neck portion 15 of the outer container 11, the inner sack 1 can be so transformed that its volume is reducible according to reduction of contents. Therefore, the inner sack 1 is easily inserted in the outer container 11 as the temporarily engaging portions 16 of the inner sack 1 slide beyond the ring-shaped neck portion 15 of the outer container 11 while transformed by pressing the housing 4 strongly.

After the O-ring 5 and the ring-shaped neck portion 15 are closely engaged airtightly, a top edge 18 of the outer container 11 is secured to the upper surface of the cover plate 14 of the housing 4 by folding the top edge 18 of the outer container 11. By this folding, the container 13 for contents and the outer container 11 are secured airtightly in a united body.

After the container 13 for contents and the outer container 11 are secured, a pin hole examination is performed for finding pin holes or the like in the inner sack 1. This pin hole examination is made by measuring gas components drawn by vacuuming upon vacuuming the inner sack 1 where the stem 7 is pressed to release the valve assembly 3. If any propellant is simultaneously withdrawn from the valve assembly 3, the inner sack 1 has some pin hole, and the product will be eliminated from this manufacturing process.

If no extraordinary matter is found in the inner sack 1 during this pin hole examination, the filling head, not shown, for contents 12 is coupled to the valve assembly 3, and the contents 12 are filled in the outer container 11 via the valve assembly 3. This filling allows the contents 12 not to contact with air because the inner sack 1 is held in a surely sealed state via the valve assembly 3. Therefore, there will be no problem even where a hair dye agent or the like that may produce oxidation upon contacts with the air is filled in the inner sack 1 or where a gel foam using an isopentane or the like generating foams upon contacts with the air is filled.

This invention thus can make the inside of the inner sack 1 not in contact with the open air since the housing 4 and the inner sack 1 are in an engagement state before those are mounted within the outer container 11. The contents 12 are filled by way of the valve assembly 3, and therefore, when filled in the inner sack 1, the contents 12 can be filled without contacting with the open air and avoid overfilling. Thus, there will be no problem where contents 12 easily oxidized or contents 12 such as gel foams generating bubbles from increase of temperature due to contacts with the open air are filled. Because this invention allows the contents to be filled without contacting the open air, it is particularly favorable for medicines, cosmetics, foods, and so on, in which prevention of contamination is strongly demanded.

Where the O-ring 5 and the ring-shaped neck portion 15 are fitted airtightly with each other, the lower end of the inner sack 1 is not in contact with the lower end of the outer container 11 as in a state that the gap 20 is formed, so that the inner sack 1 never pulls up the housing 4 as to incline the housing 4. Therefore, the container 13 for contents is surely fitted at a precise position with the ring-shaped neck portion 15 of the outer container 11, thereby preventing the gas from leaking or the like.

The container 13 for contents places the top end of the inner sack 1 at the space between the cover plate 14 of the housing 4 and the folded portion 21 of the outer container 11 where the container 13 is in close contact with the ring-shaped neck portion 15 of the outer container 11 and makes the top end of the inner sack 1 serve as a packing. Because the housing 4 and the inner sack 1 are in the engagement relation before those are mounted in the outer container 11, those are easily handled, and the work productivity can become very high.

Figure 6:
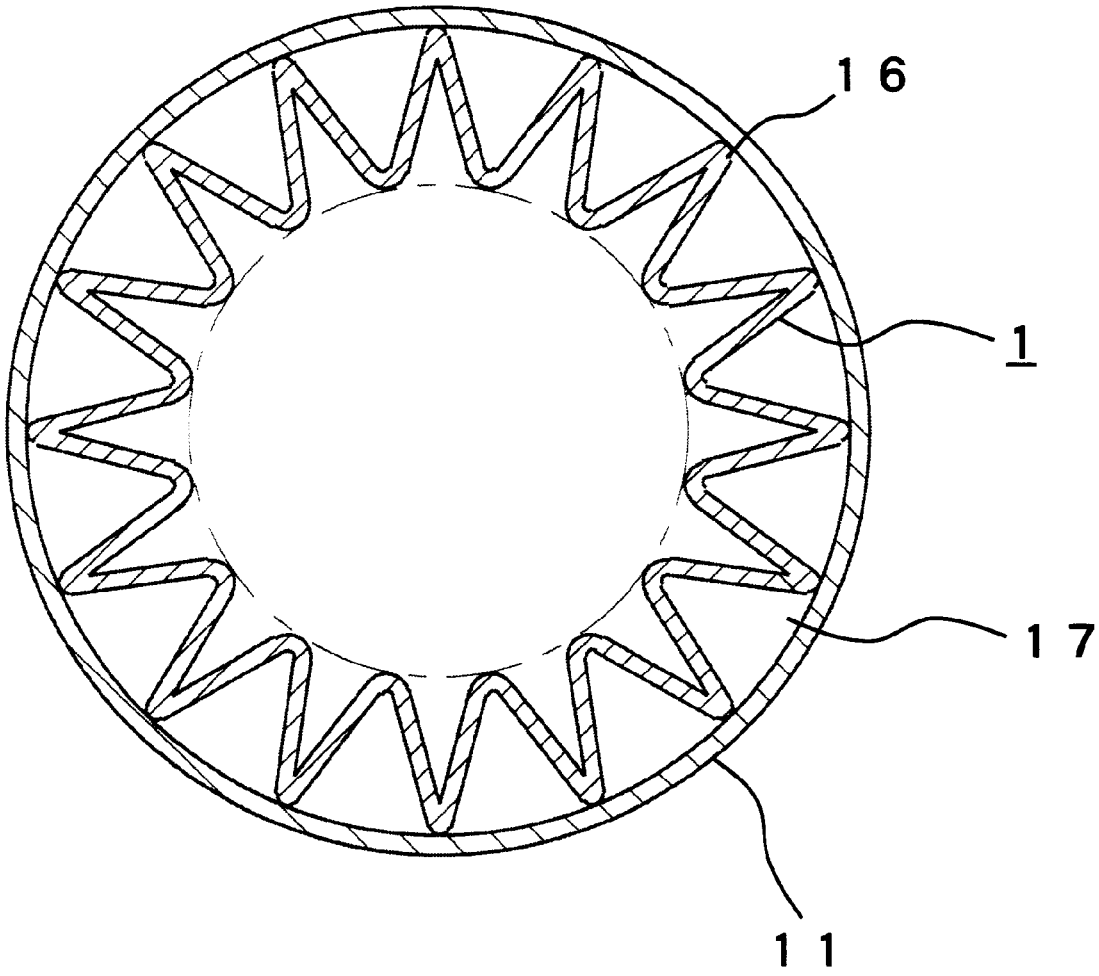
FIG. 6 is an enlarged cross section showing a cut face of the container taken along B—B line in FIG. 5.
Figure 7:
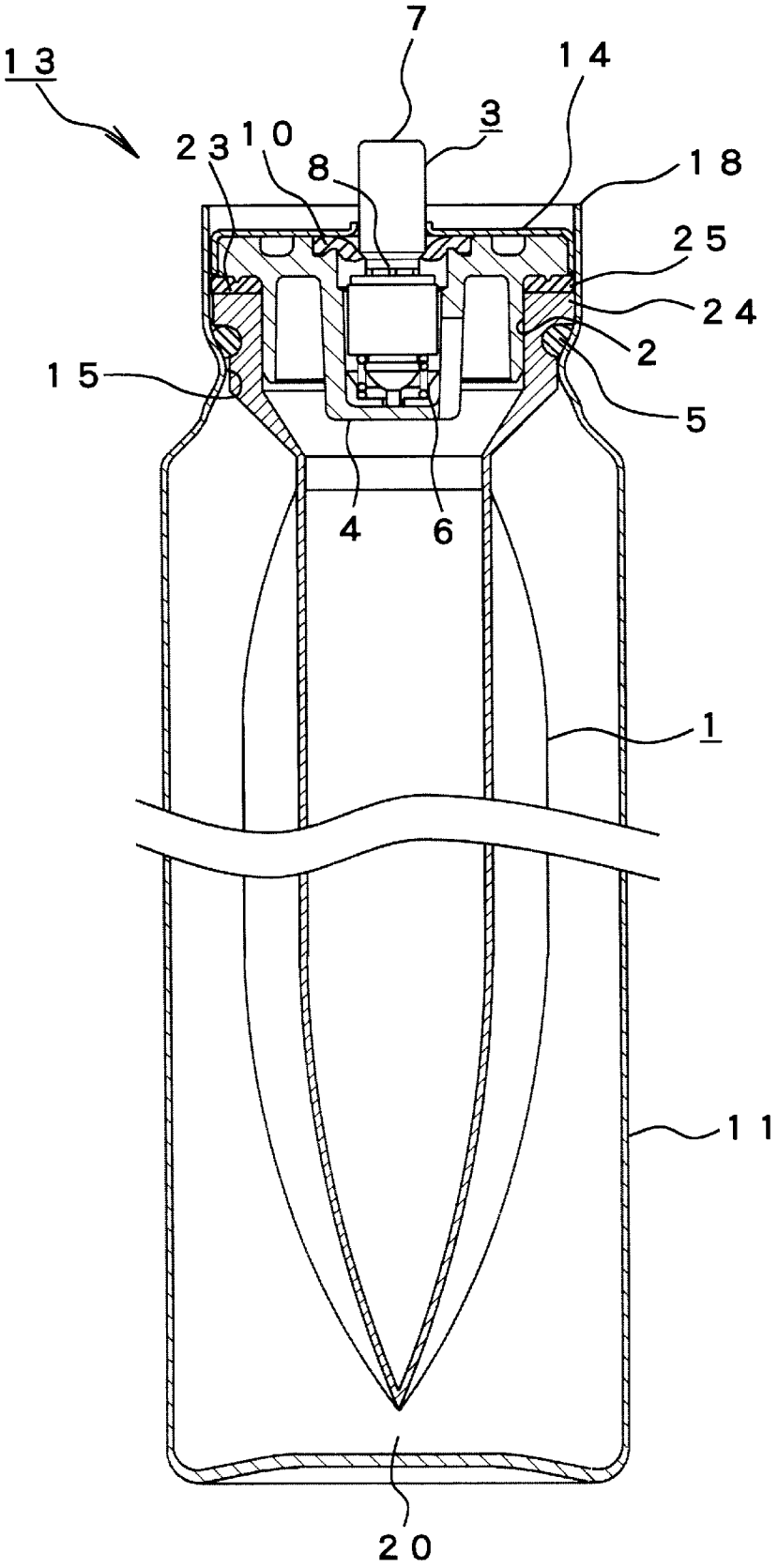
FIG. 7 is a cross section showing a state that the container for contents is fitted in the outer container before the top edge of the outer container is folded according to the second embod it of the invention.
Figure 8:
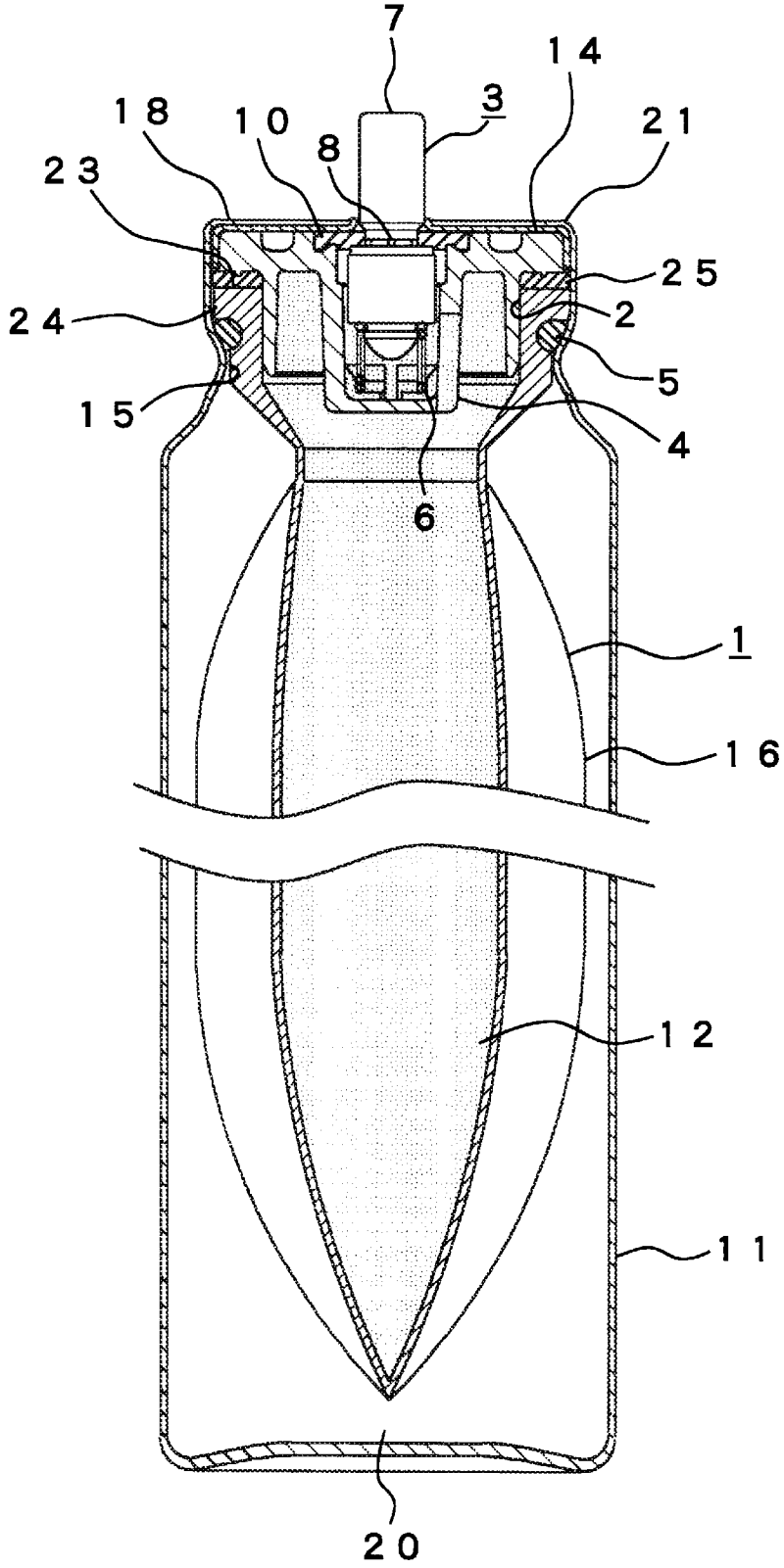
FIG. 8 is a cross section showing the container according to the second embodiment in a state that the contents are filled in the inner sack.

The inner sack 1 of this embodiment can be formed by a direct blow molding with reasonable costs. Although in the embodiment shown in FIGS. 1 to 4 the inner sack 1 is molded by the direct blow molding, the inner sack 1 is molded by an injection molding method as to form a pleat shape shown in FIG. 6 in the second embodiment shown in FIGS. 5 to 8.

In this structure, the opening 2 of the inner sack 1 is formed with a thick thickness, and a gasket 25 is placed between a top end surface 23 of the opening 2 and a flange 24 arranged at the housing 4 to keep sealing property. In this case, the top end of the inner sack 1 is not placed at a space between the cover plate 14 of the housing 4 and the folded portion 21 of the outer container 11.

In this embodiment, the inner sack 1 increases its volume equally in a width direction by widening the pleat when the contents 12 are filled. The inner sack 1 is formed of a polyethylene resin, which prevents the filled contents 12 from leaking in the outer container 11 and the propellant form coming into the inner sack 1.

Where the outer container 11 thus manufactured is manipulated, the contents 12 are well sprayed out by pressure of the propellant exerted to the entire outer peripheral surface of the inner sack 1 where the contents 12 are sprayed. Because the inner sack 1 has the pleats, the inner sack 1 is stably contracted according to reduction of the contents 12 in association with pressure given by the propellant. Consequently, spraying can be continued constantly until the end of the spraying, and the contents 12 can be sprayed without any waste.

Although in the above embodiment the inner sack 1 is made of the polyethylene resin, it can be made of polypropylene resin, polyethyleneterephthalate resin, polyacrylonitrile resin, and the like. The inner sack 1 can be formed in a single layer structure using a single kind resin as described above, and an inner sack 1 of a multiple layer structure can be formed by overlaying multiple resins. For example, an ethylene-vinylalcohol copolymer is disposed on an outer surface of the polyethylene resin, and another polyethylene resin is disposed over the surface to form an inner sack 1 of a multiple layer structure. As another embodiment, a polyethyleneterephthalate resin is disposed on an outer surface of the polyethylene resin, and another polyethylene resin is disposed on the surface to form an inner sack 1 of another multiple layer structure. In any case of the above examples, the inner sack 1 is formed properly of a material having a durability against the contents and components of the propellant.

The followings are prescriptions of the respective contents 12 where hair care products, cosmetics, deodorants, antiperspirants, other products for human being, insecticides, and household products are filled in the inner sack 1 of the above embodiments. The propellant filled in the outer container is one gas of a one kind or a mixture gas of multiple kinds selected from compression gases such as nitrogen, carbonate gas, suboxide nitrogen, air, etc., and liquid gases such as liquid petroleum gas, and diethylether, etc.

As hair preparations, exemplified are a hair spray, a hair treatment, a tonic, and a hair restorer.

| | |
|---|---|
| Hair Spray | |
| Acrylic resin alkanol amine liquid (30%) | 4.00 weight % |
| Polyoxyethylene oleyl ether | 0.01 weight % |
| Triethanol amine | 0.50 weight % |
| Perfume | 0.17 weight % |
| 99% denatured ethanol | 95.32 weight % |
| Total | 100.00 weight % |
| Hair Treatment | |
| Liquid paraffin | 1.50 weight % |
| Propylene glycol | 0.20 weight % |
| Methyl phenol polysiloxane | 0.10 weight % |
| Perfume | 0.20 weight % |
| 99% denatured ethanol | 98.00 weight % |
| Total | 100.00 weight % |
| Hair tonic | |
| Tocopherol acetate | 0.05 weight % |
| Polyoxyethylene setting castor oil (E.O 60) | 0.30 weight % |
| L-menthol | 0.28 weight % |
| d1-camphor | 0.05 weight % |
| Tincture of pepper | 0.05 weight % |
| Lactic acid | 0.02 weight % |
| Perfume | 0.20 weight % |
| 95% denatured ethanol | 57.00 weight % |
| Refined water | 42.05 weight % |
| Total | 100.00 weight % |
| Hair restorer | |
| Salicylic acid | 0.30 weight % |
| Tocopherol acetate | 0.05 weight % |
| Essence of Japanese green gentian | 0.20 weight % |
| L-menthol | 0.05 weight % |
| Concentrated glycerol | 1.00 weight % |
| 95% denatured ethanol | 60.00 weight % |
| Refined water | 38.40 weight % |
| Total | 100.00 weight % |
| Acidic hair dye (gel type) | |
| Pentyl alcohol | 10.00 weight % |
| Oleic acid | 5.00 weight % |
| Lactic acid | 5.00 weight % |
| Hydroxyethylcellulose | 2.00 weight % |
| Polyethylene glycol | 7.00 weight % |
| Dinatrium edetic acid | 0.20 weight % |
| Hyaluronic acid | 0.05 weight % |
| Colorant | 0.50 weight % |
| Dye | 0.10 weight % |
| 95% denatured ethanol | 10.00 weight % |
| Refined water | 60.15 weight % |
| Total | 100.00 weight % |

As cosmetics, exemplified are prescriptions of Eau de Cologne, sunscreen, shaving cream, beauty wash, after-shave lotion, facial mask agent, and facial cleansing agent.

| | |
|---|---|
| Eau de Cologne | |
| Dimethyl polysiloxane | 0.70 weight % |
| POE glycerol triisostearate | 1.00 weight % |
| Perfume | 2.00 weight % |
| Polyoxyethylene setting castor oil (E.O 60) | 1.00 weight % |
| Refined water | 35.00 weight % |
| 95% denatured ethanol | 60.30 weight % |
| Total | 100.00 weight % |

-continued

| Sunscreen | |
|---|---|
| Cetyl octanate | 30.00 weight % |
| Benzophenone-3 | 3.00 weight % |
| Tocopherol acetate | 0.10 weight % |
| Octyl methoxycinnamate | 6.00 weight % |
| Mineral Oil | 60.90 weight % |
| Total | 100.00 weight % |
| Shaving cream (shave gel later foaming) | |
| Palmitic Acid | 10.00 weight % |
| Dibuthyl hydroxytoluene | 0.10 weight % |
| Oleyl alchol | 1.00 weight % |
| Glycerol | 5.00 weight % |
| Sorbitol liquid (70%) | 5.00 weight % |
| Hydroxyethylcellulose | 0.50 weight % |
| Triethanolamine | 6.50 weight % |
| Preservatives | 0.20 weight % |
| Dye (1% solution) | 0.05 weight % |
| Isopentane/isobutane 95/5 | 0.35 weight % |
| Refined water | 68.15 weight % |
| Total | 100.00 weight % |
| Beauty wash | |
| Citric acid | 0.10 weight % |
| Zinc paraphenol sulfonic acid | 0.20 weight % |
| Sorbitol liquid (70%) | 0.15 weight % |
| Glycerol | 0.10 weight % |
| Polyoxyethylene setting castor oil (E.O 60) | 0.50 weight % |
| Preservatives | 0.20 weight % |
| Perfume | 0.10 weight % |
| 95% denatured ethanol | 1.50 weight % |
| Refined water | 97.15 weight % |
| Total | 100.00 weight % |
| After-shave (gel) | |
| Carboxyvinyl polymer | 0.25 weight % |
| Isopropylmethylphenol | 0.30 weight % |
| Triethanolamine | 2.50 weight % |
| Perfume | 0.10 weight % |
| Allantoin | 0.10 weight % |
| 1,3 butylene glycol | 1.50 weight % |
| Preservatives | 0.12 weight % |
| 95% denatured ethanol | 15.00 weight % |
| Refined water | 80.13 weight % |
| Total | 100.00 weight % |
| Facial mask agent | |
| Polyvinyl alcohol | 15.00 weight % |
| Carboxymethylcellulose | 5.00 weight % |
| Polypropylene glycol | 3.00 weight % |
| Perfume | 0.10 weight % |
| Preservatives | 0.20 weight % |
| 95% denatured ethanol | 10.00 weight % |
| Refined water | 66.70 weight % |
| Total | 100.00 weight % |
| Facial cleansing agent | |
| Polyethylene glycol | 0.30 weight % |
| Perfume | 0.20 weight % |
| Carboxyvinyl polymer | 2.00 weight % |
| Cocoyl amide propyldimethyl glycine | 20.00 weight % |
| Diethanolamide coconut oil fatty acid | 2.00 weight % |
| Citrus Acid | 0.10 weight % |
| Preservatives | 0.20 weight % |
| Dye (1% solution) | 0.05 weight % |
| 95% denatured ethanol | 0.95 weight % |
| Refined water | 74.20 weight % |
| Total | 100.00 weight % |

The following example is a prescription of an antiperspirant-deodorant.

| Antiperspirant - Deodorant | |
|---|---|
| Dipropylene glycol | 4.00 weight % |
| Tetrahydropropylethylenediamine | 0.20 weight % |
| Zinc phenol sulfonic acid | 2.00 weight % |
| Perfume | 0.10 weight % |
| Citrus acid | 0.40 weight % |
| Isopropylmethylphenol | 0.20 weight % |
| 95% denatured ethanol | 32.00 weight % |
| Refined water | 61.10 weight % |
| Total | 100.00 weight % |

The following examples are prescriptions of a muscular antiphlogistic, and an insect repellent as other body treatment products.

| Muscular antiphlogistic | |
|---|---|
| L-menthol | 3.00 weight % |
| Methyl salicylate | 2.70 weight % |
| Tocopherol acetate | 0.20 weight % |
| 99% denatured ethanol | 94.10 weight % |
| Total | 100.00 weight % |
| Insect repellent | |
| N,N-diethyl-m-toluamide | 4.00 weight % |
| Di-N-propyl-isocinchomeronate | 1.00 weight % |
| N-(2-ethyl hexyl)-bicyclo 2.2.1-hepta-5-en-2.3-dicarboxyimide | 2.00 weight % |
| Polyoxyethylene glycol #400 | 1.50 weight % |
| 99% denatured ethanol | 91.50 weight % |
| Total | 100.00 weight % |

The following examples are prescriptions of an insecticide for cockroach and an insecticide for gardening.

| Insecticide for cockroach | |
|---|---|
| O,O-dimethyl-O-(3-methyl-4-nitrophenyl) thiophosphate | 1.25 weight % |
| Piperonyl butoxide | 1.95 weight % |
| Perfume | 0.01 weight % |
| Kerosine | 96.79 weight % |
| Total | 100.00 weight % |
| Insecticide for gardening | |
| (1,3,4,5,6,7-hexahydro-1,3 dioxo-2-isoindolyl) methyl-dl-cis/trans-chrysanthemate | 0.20 weight % |
| Polyoxyalkyl phosphate | 0.20 weight % |
| Isopropyl alcohol | 4.00 weight % |
| Refined water | 95.60 weight % |
| Total | 100.00 weight % |

The following examples are prescriptions of a deodorant for garbage and a waterproofing spray as household products.

| Deodorant for garbage | |
|---|---|
| Lauric methacrylate | 2.00 weight % |
| Isopropyl methylphenol | 0.20 weight % |
| Hinokitiol | 0.01 weight % |
| Dipropylene glycol | 0.90 weight % |
| Perfume | 1.00 weight % |
| 99% denatured ethanol | 95.89 weight % |
| Total | 100.00 weight % |
| Waterproofing spray | |
| Fluororesin | 1.20 weight % |
| Methyl polysiloxane | 2.50 weight % |
| Hexylene glycol | 5.00 weight % |
| 99% denatured ethanol | 91.30 weight % |
| Total | 100.00 weight % |

Since this invention is thus constituted, the contents in the inner sack are never in contact with the open air, and the contents are surely filled in the inner sack where the air is cut off during the manufacturing process. Therefore, even where the contents filled in the inner sack are readily oxidized, or are medicines, cosmetics, foods, and so on, which are readily subject to contamination in contact with the open air, or are materials that generates bubbles by temperature increase due to contacts with the open air, the contents can be surely filled without being deteriorated.

Since the inner sack and the housing enter in an engagement relation before those are mounted in the outer container, the inner sack is readily set in the outer container during the manufacturing process and renders manufacturing productive and flawless.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A double chamber aerosol container comprising:

an outer container having a hollow interior and a ring-shaped neck portion extending radially inward from a surface of the hollow interior;

an inner sack, whose volume is reducible according to reduction of contents, inserted in the hollow interior of the outer container to be mounted, the inner sack having an opening for containing the contents and a plurality of temporarily engaging portions extending from an outer surface of the inner sack radially more outward than the neck portion;

a housing formed with a valve assembly and inserted in an inner periphery of the opening of the inner sack for constituting, together with the inner sack, a container for the contents; and an O-ring tightly secured to an outer periphery of the inner sack to engage the inner sack with the housing, wherein the inner sack and the outer container are temporarily fitted with each other by engagement of the temporarily engaging portions of the inner sack with the ring-shaped neck portion, wherein a filling gap for propellant is formed between the inner sack and the aerosol container while the inner sack and the outer container are temporarily fitted, and wherein the O-ring is airtightly engaged with the ring-shaped neck portion at a time of a permanent engagement in which the container for contents are inserted in the outer container.

2. A method for manufacturing a double chamber aerosol container comprising the steps of:

inserting a housing formed with a valve assembly into an inner periphery of an opening of an inner sack, whose volume is reducible according to reduction of contents, the inner sack having a plurality of temporarily engaging portions extending outward from an outer surface of the inner sack radially more than a ring-shaped neck portion extending radially inward from a surface of the hollow interior of an outer container to engage the housing with the inner sack by means of an O-ring tightly secured to an outer periphery of the inner sack;

temporarily engaging the temporarily engaging portions of the inner sack with the ring-shaped neck portion upon inserting in the outer container the inner sack of a container for contents, which is constituted of the inner sack and the housing, to form a filling gap for propellant between the outer container and the temporarily engaging portions of the inner sack while the temporarily engaging portions and the ring-shaped neck portion are temporarily engaged;

filling the propellant in the outer container upon connecting a filling head for propellant to the outer container while the temporarily engaging portions and the ring-shaped neck portion are temporarily engaged;

securing a top edge of the outer container to an upper surface of the housing by folding the top edge after the O-ring is airtightly engaged with the ring-shaped neck portion upon inserting the inner sack in the outer container as the temporarily engaging portions of the inner sack slide beyond the ring-shaped neck portion of the outer container, and filling the contents in the inner sack via the valve assembly after the inner sack and the outer container are thus permanently engaged.

* * * * *